United States Patent [19]

Renard et al.

[11] Patent Number: 5,016,710

[45] Date of Patent: May 21, 1991

[54] METHOD OF ASSISTED PRODUCTION OF AN EFFLUENT TO BE PRODUCED CONTAINED IN A GEOLOGICAL FORMATION

[75] Inventors: Gërard Renard, Rueil Malmaison; Jean-Francois Giannesini, Saint Cloud, both of France

[73] Assignees: Institut Francais du Petrole, Rueil Malmaison; Societe Nationale Elf Aquitaine (Production), Paris La Defense, both of France

[21] Appl. No.: 66,534

[22] Filed: Jun. 26, 1987

[30] Foreign Application Priority Data

| | | | |
|---|---|---|---|
| Jun. 26, 1986 | [FR] | France | 86 09419 |
| Jun. 26, 1986 | [FR] | France | 86 09420 |
| Jun. 26, 1986 | [FR] | France | 86 09422 |

[51] Int. Cl.[5] ..... E21B 43/22; E21B 43/24; E21B 43/30

[52] U.S. Cl. ..... 166/245; 166/50; 166/52; 166/268; 166/272

[58] Field of Search ..... 166/50, 52, 57, 62, 166/106, 245, 268, 272, 303

[56] References Cited

U.S. PATENT DOCUMENTS

| | | | |
|---|---|---|---|
| 1,520,737 | 12/1924 | Wright | 166/265 |
| 2,404,341 | 7/1946 | Zublin | 166/268 X |
| 3,386,508 | 6/1968 | Bielstein et al. | 166/272 |
| 3,572,436 | 3/1971 | Riehl | 166/272 X |
| 4,099,570 | 7/1978 | Vandergrift | 166/303 |
| 4,201,420 | 5/1980 | Likolai et al. | 166/50 X |
| 4,368,781 | 1/1983 | Anderson | 166/272 X |
| 4,460,044 | 7/1984 | Porter | 166/272 X |
| 4,463,988 | 8/1984 | Bouck et al. | 166/272 X |
| 4,532,986 | 8/1985 | Mims et al. | 166/52 |
| 4,646,824 | 3/1987 | Huang et al. | 166/50 X |
| 4,702,314 | 10/1987 | Huang et al. | 166/268 X |

*Primary Examiner*—George A. Suchfield
*Attorney, Agent, or Firm*—Antonelli, Terry, Stout & Kraus

[57] ABSTRACT

The present invention provides a system and method for producing an effluent contained in a geological formation forming a reservoir for said effluent or producing formation, including a central well, at least one subhorizontal drain as well as a displacing or displacement agent, the displacement agent being injected into the formation either from the central well or from the subhorizontal drain and the displacement agent causes migration of the effluent to be produced.

26 Claims, 5 Drawing Sheets

209
215
201
214
206
202
212
213
210
204
L
207
205
203
211
206

METHOD OF ASSISTED PRODUCTION OF AN EFFLUENT TO BE PRODUCED CONTAINED IN A GEOLOGICAL FORMATION

BACKGROUND OF THE INVENTION

The present invention relates to a method for the assisted production of an oil effluent, more particularly a viscous effluent, contained in a geological formation lying over another formation which does not contain the effluent to be produced and which is impermeable to said effluent.

Description of the Prior Art

The method of the present invention allows better working of the formation containing the effluent to be produced, while limiting the number of wells to be drilled relatively to the methods used in the prior art, which may be illustrated by the U.S. Pat. No. 3 386 508.

In this prior patent, a main well is drilled as well as other wells which will be termed auxiliary wells. These auxiliary wells which are inclined join up with the main well at the level of the formation containing the effluent to be produced.

The production mechanism described in this prior patent resides in the fact that it is the portion of the auxiliary well situated in the formation to be produced which serves for collecting the effluent to be produced which is situated close to the auxiliary well.

Moreover, in this prior patent, production takes place by using the gravity phenomenon for draining the effluent towards the main well. Now, the intensity of the force of gravity is limited by the height between the roof of the formation containing the effluent to be produced and the position where the auxiliary well opens into the main well, when the formation containing the effluent to be produced is situated between two other formations which do not contain the effluent to be produced.

According to this prior patent, this height is at most equal to that of the formation containing the fluid to be produced.

The present invention provides a method for improving the recovery of the fluid to be produced.

This improvement results, for certain embodiments, in a better recovery rate due to the increase in the gravity effects allowing draining and in working an extended zone with a reduced number of wells.

SUMMARY OF THE INVENTION

In order to improve the productivity of the system, the present invention provides for sweeping the reservoir by injecting into the formation a displacement fluid or displacing fluid, either from a central well or from one or more subhorizontal drain it.

By subhorizontal drains is meant a drain whose tilt approaches 90°, but without actually reaching it.

The advantages of this new system are that it allows:

a more extensive range of reservoirs to be worked, in particular those containing an oil of lower viscosity, an improvement of the volume swept, the production of each drain to be distinguished and the problems of local heterogeneites of the reservoir to be remedied while searching for an adequate solution in the drain concerned, and for some embodiments, particularly when the displacement fluid is injected through the main well, it allows the phenomenon to be used in the reservoir of segregation of fluids of very different densities by injecting gas or vapor so as to form a gas umbrella at the roof of the reservoir, without premature breakthrough to the drains, considering the high tilt thereof, this tilt being close to the horizontal, the losses to be reduced through fluids injected outside the area covered by the system, a single source of injection to be used situated close to the center of production.

The present invention relates to a method of producing an effluent contained in a geological formation forming a reservoir for said effluent, or productive formation, using a central well, at least one subhorizontal drain, as well as a displacing or displacement agent, said geological formation overlying another geological formation substantially impermeable to said effluent or impermeable formation, the interface between said geological formations being designated as a wall of said reservoir.

In accordance with the present invention, said displacement agent is injected into said formation either from said central well or from said subhorizontal drain and said displacement agent causes the migration of the effluent to be produced.

In a variant of the present invention, applied to the production of a viscous oil effluent, a central well may be used as production well and at least one subhorizontal well as production stimulating well. The stimulating well may be drilled from the surface and pass through the producing formation so as to pass through said impermeable formation and join up with the production well.

The stimulation well may be drilled over a portion of its length, this portion corresponding substantially to the fraction of the stimulation well passing through the producing formation.

A fluid may be injected into the stimulation well adapted for reducing the viscosity of the oil effluent to be produced so as to increase the flow rate in the stimulation well.

A plug may be interposed in the stimulation drain and the plug may be placed in the drilled portion of &he stimulation drain.

A plug may also be interposed in the stimulation drain in the portion of said drain contained in the non producing formation.

A plug may also be placed in the stimulation drain substantially at the limit of the producing formation and the non producing formation.

The stimulation drain may be interrupted after reaching the producing formation, but before it reaches the producing well.

In a variant of the method of the present invention, the displacement agent or displacing agent may be injected from the central well and several subhorizontal drains may be used.

In a subvariant of the present invention, the vertical central well is not used only for conveying to the surface the production collected by the subhorizontal drains but it is equipped with a particular completion so that a fluid may also be Injected into the reservoir.

Generally, this subvariant relates to a method for producing an effluent contained in a geological formation forming a reservoir from said effluent, using a central well, subhorizontal drains as well as a displacing agent, said geological formation overlying another geological formation substantially impermeable to said effluent, the interface between said geological formations being termed wall of said reservoir.

This method is characterized in that said displacing agent is injected into said formation from said central well, said displacing agent causing the migration of the effluent to be produced and this effluent is drained by said horizontal drains towards a lower part of the central well where it transits and from which it is produced to the surface.

In this subvariant, said effluent to be produced may be collected by subhorizontal drains situated all around said central well.

Also, in this subvariant, said effluent to be produced may be drained into said lower part, as far as a level lower than said wall of the reservoir.

In another subvariant, the vertical central well is not used for conveying to the surface the production collected by the subhorizontal drains, but it is equipped with a completion for injecting the fluid into the reservoir. It is the subhorizontal drains themselves which are used for conveying the production to the surface.

Generally, this new subvariant relates to a method for producing an effluent contained in a geological formation forming a reservoir for said effluent, using a central well, subhorizontal drains as well as a displacement agent or displacing agent, said geological formation overlying another geological formation substantially impermeable to said effluent, the interface between said geological formations being termed wall of said reservoir. In this method said displacement agent is injected into said formation from said central well and said agent causes a migration of the effluent to be produced, this latter being conveyed to the surface by said subhorizontal drains.

In this subvariant, said effluent may be produced by subhorizontal drains situated all around said central well.

The present invention also relates to a system for producing an effluent contained in a geological formation including a central well and subhorizontal drains. In this system, said main well includes a perforated zone at the level of said geological formation, an injection pipe connecting said perforated zone to a source of injection of a displacement product, and said subhorizontal drains pass into said formation In one embodiment of this production system, the main well may further include a transit zone isolated from the perforated zone and situated below said perforated zone, said transit zone being connected to the surface by a production pipe and said subhorizontal drains pass into said formation so as to join up with said transit zone.

The production system used for this embodiment may also include a tube situated in said well forming the production pipe. The injection pipe may be formed of the annular space defined by said main well. Said tube may include a plug which isolates the perforated zone from the transit zone.

This tube may pass through said plug. The production pipe may include a pump situated at its lower end in the transit zone and the tube forming said production pipe may slide in said plug.

The transit zone may have a cross section larger than the cross section of the upper part of a central well, thus forming a pit for collecting the effluent produced.

The system of the invention may be advantageously applied to the case where said geological formation overlies another geological formation impermeable to the effluent to be produced. In this application, said collection zone may be situated at least partially in said impermeable formation and said subhorizontal drains may join up with said transit zone while passing through said impermeable formation after having passed through the producing formation In another possible embodiment, the subhorizontal drains which pass into the formation may have a length such that they are interrupted at a certain non zero distance from the axis of the main well.

The injection well may include a plug.

The system of the invention may be advantageously be applied to the case where said geological formation overlies another geological formation impermeable to the effluent to be produced. In this application the collection drains may be interrupted substantially in the vicinity of the interface between said impermeable formation and said formation containing the effluent to be produced.

BRIEF DESCRIPTION OF THE DRAWINGS

The present invention will be better understood and its advantages will appear more clearly from the following description of particular examples illustrated by the accompanying drawings showing the working of a geological formation contains an oil effluent wherein.

DESCRIPTION OF THE PREFERRED EMBODIMENTS

Figure 1:
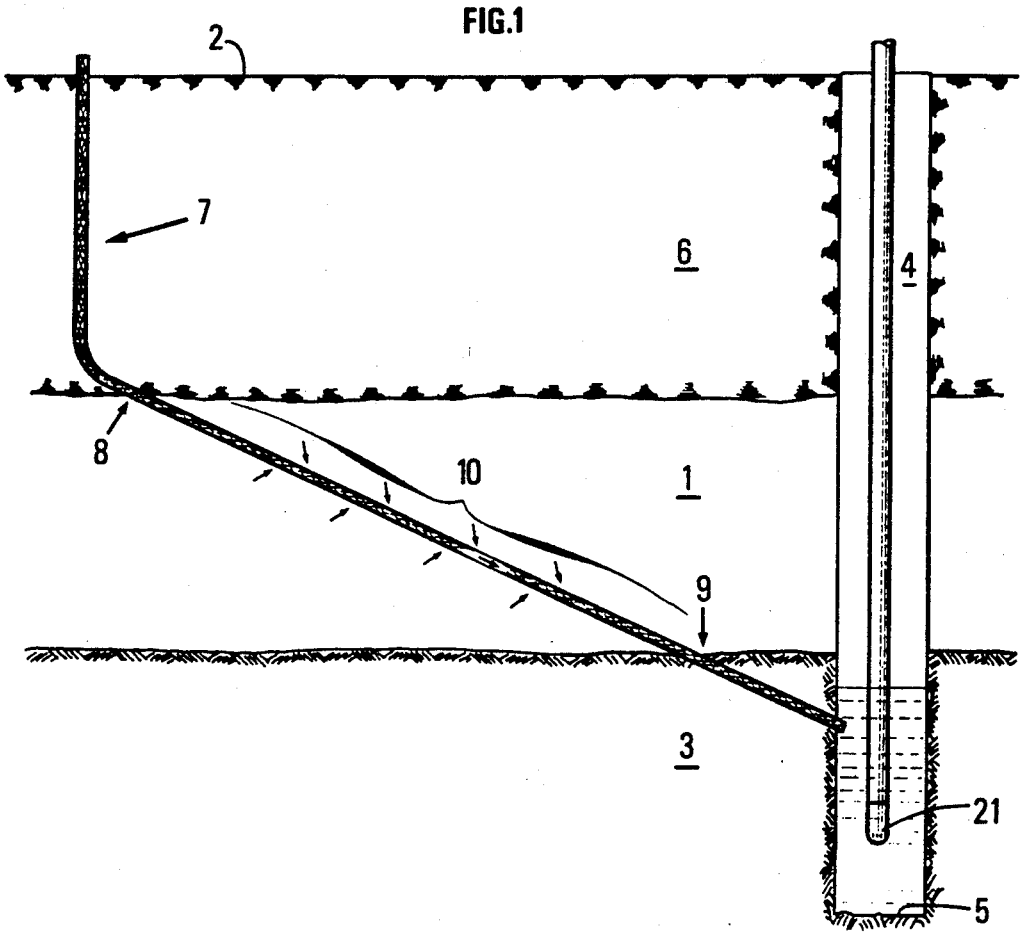
FIG. 1 shows the configuration of a main well and of a stimulation well or auxiliary well for putting into practice the method of the invention.

The present invention shows the implementation of a variant of the method of the invention for bringing in a geological formation 1 from the surface of the ground 2. The geological layer 1 contains a viscous oil effluent to be produced.

Reference 3 designates a geological formation situated below the producing formation 1. This lower formation is impermeable to the effluent to be produced contained in the producing formation.

Reference 4 designates a main well drilled from the surface 2 and passing through the producing formation 1, this main well being interrupted at 5 in the impermeable formation 3.

In the case of FIG. 1, the producing formation is overlaid by another formation bearing the reference 6 and which will be called upper formation.

Reference 7 designates an auxiliary well or drain for stimulating and draining a fraction at least of the production of the viscous effluent contained in formation 1.

In FIG. 1, this stimulation well passes through the upper formation 6 as well as the producing formation 1 and passes into the lower impermeable formation 3 to join with the main well 4 at the level of this lower formation.

More generally, in accordance with the present invention, the auxiliary well opens into the main well at the level of a formation situated below the producing formation, after penetrating a formation impermeable &o the fluid to be produced.

In FIG. 1, reference 8 designates the position at which the stimulation well or drain 7 penetrates into the producing formation 1 and reference 9 the position at which it leaves. Reference 10 designates the portion of the stimulation well included in the producing formation 1.

Of course, it is preferable in accordance with the present variant for the portion 10 of the stimulation drain 7 situated in the producing formation 1 to be as long as possible.

In the case of FIG. 1, production is achieved by causing a stimulating agent to flow in the stimulation drain 7. This agent causes a reduction of the viscosity of the effluent to be produced, in the vicinity of the drain. The effluent to be produced then flows towards the main well 4 via the stimulation drain itself.

Of course, the portion 10 of the stimulation drain 7 situated in the producing formation 1, when this portion is not formed by an uncovered well, may be already perforated before being lowered into the well, such a perforated drain portion is generally designated by the term "liner" or else be perforated in position. Furthermore, it may be possible to replug certain perforations of the stimulation drain 7.

Figure 2:
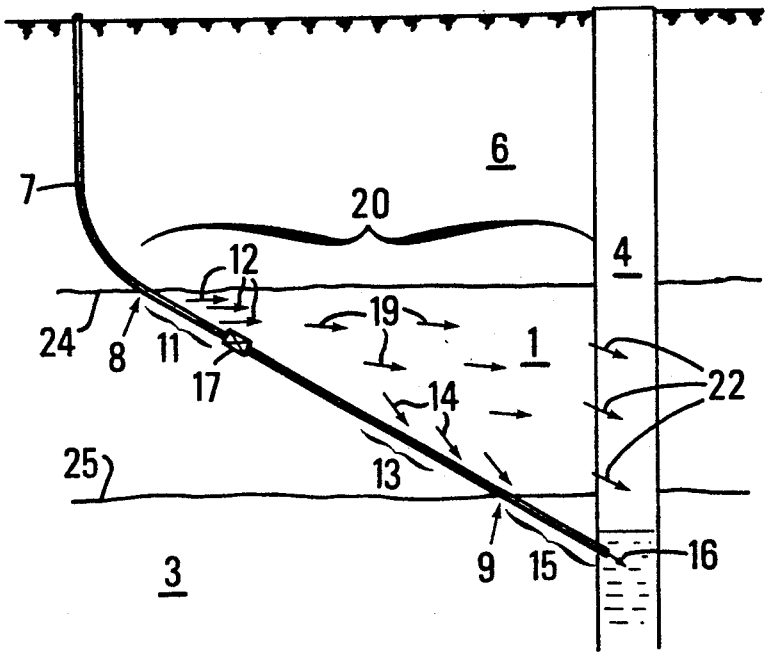
FIG. 2 illustrates the production mechanism of the present invention.

FIG. 2 illustrates a second production method in accordance with the present variant. In this method, the portion 10 of the stimulation drain situated in the producing formation 1 is perforated solely in two portions of its length 11 and 13, a plug 17 being placed in said drain so as to separate these two portions.

An agent is injected into the stimulation drain 7 for reducing the viscosity of the oil effluent to be produced situated in the producing formation 1, so as to facilitate the flow of the effluent to be produced.

Such an agent may be formed by steam or include other products, such as a solvent, for example with a hydrocarbon basis.

In the example described, the agent considered will be steam.

The steam injected from the surface penetrates into the producing formation 1 through the upper part of the perforations 11.

Diffusion of the steam in the producing formation 1 is shown by arrows 12.

The steam heats the oil effluent contained in the producing formation 1, particularly by condensing, thus causing a decrease in the viscosity of the effluent to be produced, a fraction of which flows consequently towards the lower part of the perforations 13.

The flow of the effluent produced is shown by arrows 14. This flow occurs in the direction of the lower part of the stimulation well 1 by gravity and by the presence of a pressure gradient decreasing in the direction of a stimulation well.

This decrease in the pressure gradient is due to the fact that the stimulation well 10 is placed in communication with the main well 4 which is itself in communication with the surface and is therefore substantially at the surface atmospheric pressure.

The effluent to be produced flows through the part of the stimulation drain 15 situated in the lower formation 3 as far as &he main well 4 in the bottom of which it collects.

This flow is shown by arrow 16 in FIG. 2.

The effluent thus produced is raised conventionally from the main well 4 by means of pumps 21 controlled from the surface.

In the case of the above described example, the separation between the portion 11 of the perforations from which the steam diffuses into the producing formation and the portion 13 of the perforation from which the effluent to be produced flows, is provided by interpositioning plug 17. In this case, steam 12 is forced to leave the auxiliary drain 7 upstream of plug 17 and the oil effluent is produced downstream of plug 14. Thus, it is easy to control the place of separation.

A fraction of the steam injected 12 diffuses into the producing formation 1, that is to say towards well 4, thus keeping a large zone 20 belonging to the producing formation and situated between portion 10 of the stimulation drain 7 and the main well. This fraction is shown by arrows 19 and causes the effluent to be produced to come directly into well 4, this is shown by arrows 22.

It is possible to position a plug 18 substantially at the limit of the interface separating the producing formation 1 and the lower impermeable formation 3, (FIG. 3), in accordance with the present variant, the stimulation drain 7 being perforated over the whole of its length present in the producing formation.

Figure 3:
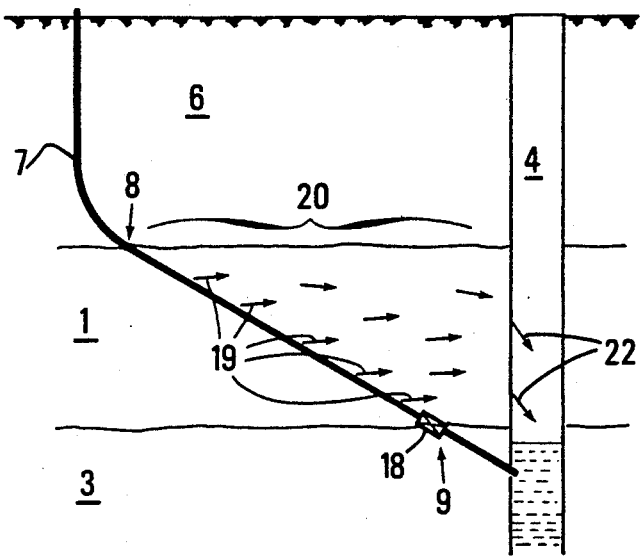
FIGS. 3 and 4 show different variants of the present invention.

In this case, of course, the lower part 15 of the stimulation drain 7 produces nothing. All the production takes place directly in well 4, as shown by arrows 22. The stimulation drain 7 serves solely for injecting the stimulation agent. This is shown by arrows 19 (FIG. 3).

Figure 5:
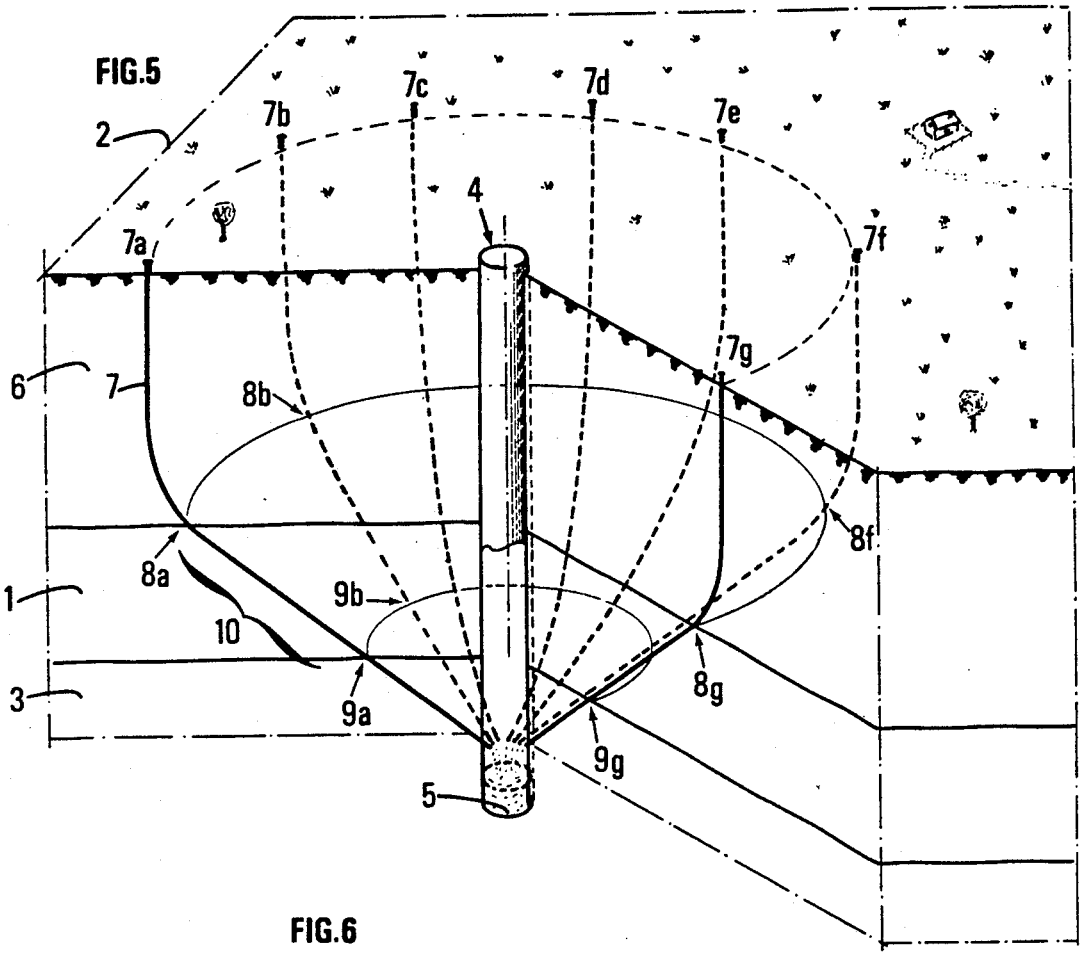
FIGS. 5 and 6 illustrate a general view of bringing in a formation viscous effluent to be produced.
Figure 6:
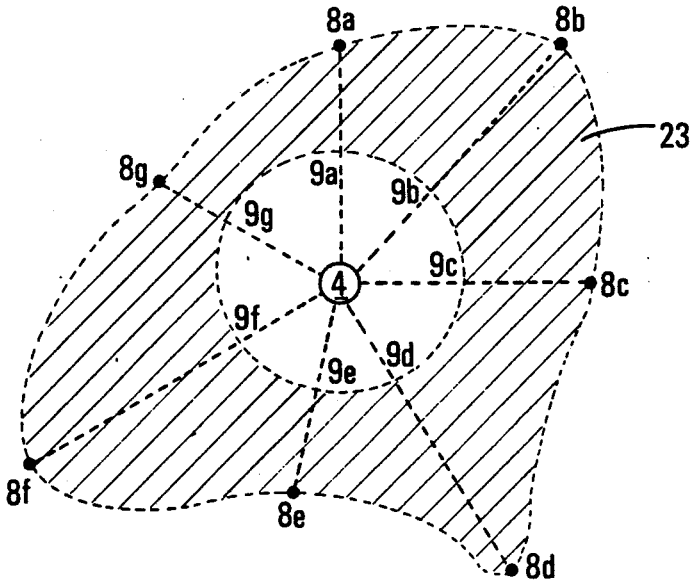

FIGS. 5 and 6 show a general production diagram. The main well 4 is surrounded by a certain number of stimulation wells $7_a \ldots 7_i$.

In FIG. 5, these wells are, are the surface, equidistant from the main well 4. This is not essential and wells $7a \ldots 7_i$ may be placed at distances from the main well which are best suited to the working of the producing formation.

References $8_1 \ldots 8_i$ designate the positions where the drains $7a \ldots 7_i$ penetrate into the producing formation 1 and the references $9_a \ldots 9_i$ the positions where they leave.

Thus, it is possible to work the whole hatched zone 23 (FIG. 6), with the interpositioning of plugs $9_1 \ldots 9_i$ In the case shown in FIG. 6, the points $9_1 \ldots 9_i$ are equidistant from the main well 4, but this is in no wise obligatory.

It is possible, when a plug 17 is used, to very the position thereof as a function of the working of the different zones.

Thus, for beginning injection it will be possible to position the plug 17 so that it is situated in the producing formation, while being relatively close to the interface 24 between the upper formation 6 and the producing formation 1. Then, as the production progresses, it will be possible to lower plug 17. The reverse is also possible. That is to say to begin by placing plug 17 the closest possible to the lower interface 25 between the producing formation 1 and the lower formation 3, then raising the position of plug 17 as the producing formation is worked.

Figure 4:
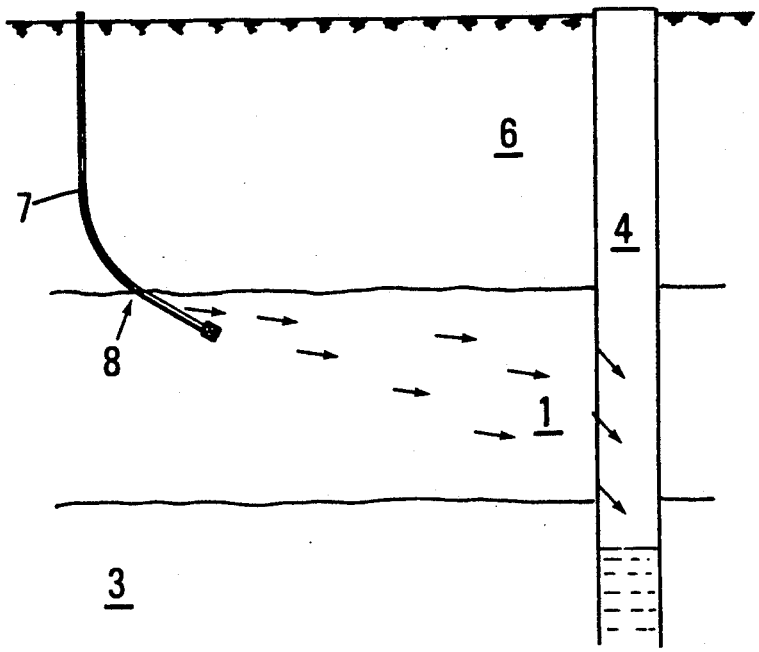

If during the drilling of a stimulation well 7, difficulties are met with when this is in the producing formation, it will be possible to use it as stimulation injection drain. This is shown in FIG. 4 where drain 7 only serves for injecting the stimulating agent.

Figure 7:
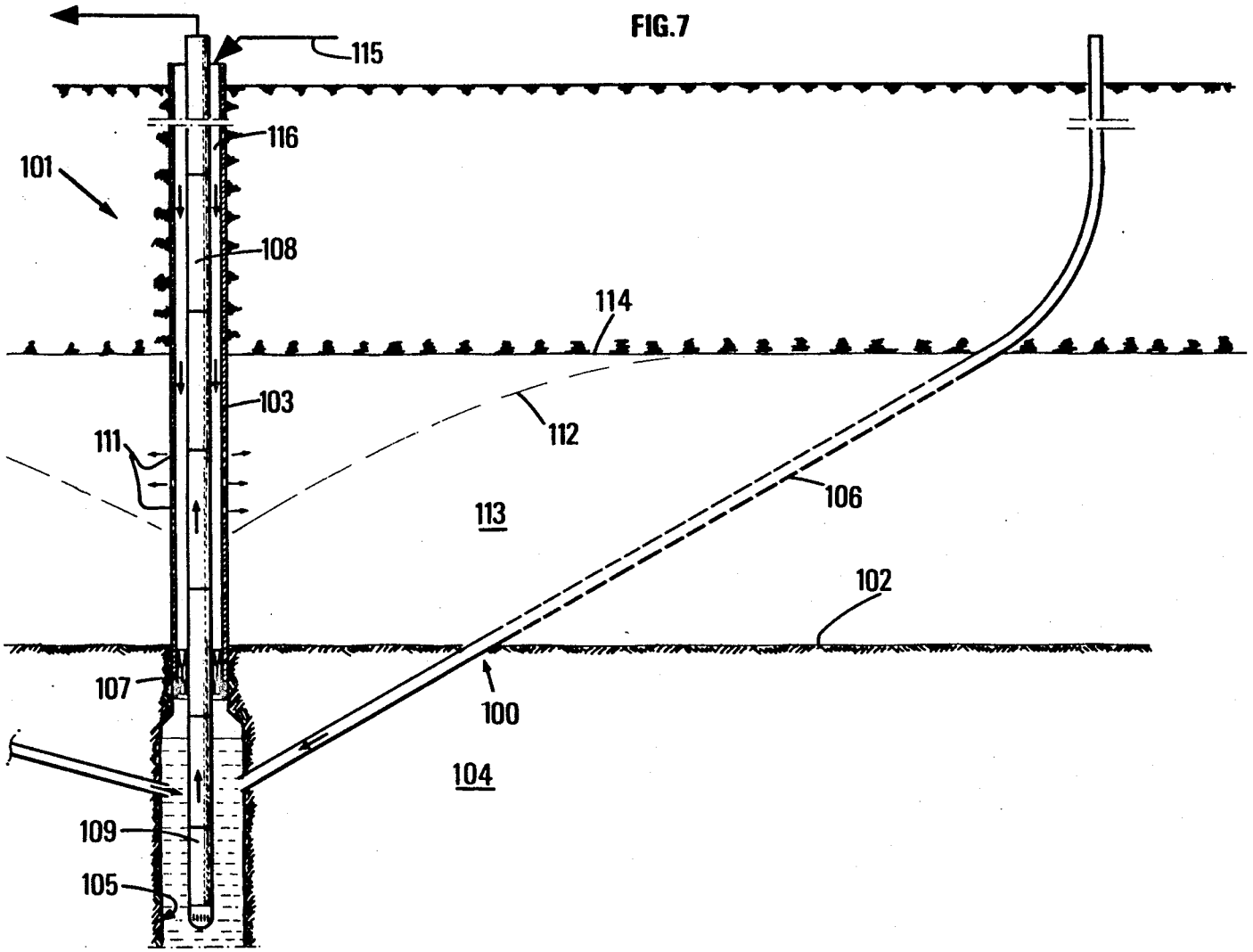
FIGS. 7 and 8 illustrate two variants in which a central well serves for injecting the displacement agent.

In another variant in which the central well serves for injecting the displacement agent (FIG. 7), this vertical central well 101 is drilled as far as the wall 102 of a reservoir 113, then cased and cemented. Thus casing 103 prevents any flow of fluids from the reservoir into the well.

By wall of the reservoir is meant the lower part of the geological formation containing the oil effluent and by roof of the reservoir the upper limit of this geological formation.

Drilling is then continued to a larger diameter by means of a hole opener in layer 104 situated under the reservoir, so as to form a pit 105 for receiving the fluids collected by subhorizontal drains 106. This pit will be isolated from the rest of the hole by means of a sealing plug 107 of the type generally designated by the term "packer", for passing a pipe 108 for raising the production of fluids collected to the surface by means of a pumping device 109. The packer 107 may be equipped with a sliding seal allowing vertical movement of the pipe while providing perfect sealing. Pipe 108 may include several pipe elements connected end to end.

The collecting device will be finished by drilling subhorizontal drains 106 from the surface as far as the collecting pit 105. Each of these drains intersecting each wall 102 of the reservoir at a point 100 whose distance to the central well, depending on the tilt of the drain, will be an important parameter of the system, since any production of fluids in place or of injected fluid will leave the reservoir at this point. The production flow rate of a system will be chosen so that the liquid level in the pit is always below the level of the wall of the reservoir so that the fluids collected may be discharged through the drains in line with the reservoir.

The injection of fluid for mobilizing and displacing the fluids in position will take place in reservoir 113 through perforations 111 formed conventionally in the casing 103 of the central well 101. The communication may be improved by acidification and stimulation of the reservoir at the level of the perforations. The size of these perforations 111 may be chosen after simulation by means of digital programs adapted for representing the flows caused until the best volumetric sweeping of the reservoir is obtained by the injected fluids (hot water, steam, $CO_2$, gas, foam,) as far as penetration into the drains. The parameters to be taken into account are: the thickness of the reservoir, the viscosity of the oil in place, the angle of the drains with respect to the horizontal, the outlet points from the reservoir of each drain, the injection rate, the number of drains, ...

In the case where the injected fluid is lighter than the oil in place, advantage will be taken of the gravity segregation effect, which allows a form of umbrella to be obtained for the interface between the displacement agent and the effluent to be produced. During time, this umbrella shape will develop laterally about the central well. The above mentioned parameters may then be calculated so that the limit reached by the umbrella is practically parallel to the subhorizontal drains in the respective planes of each of them. Thus, the oil will be displaced towards the drains uniformly.

In the initial phase of production, as for the previously proposed system, it will be advantageous, in the case of heavy oil reservoirs, to provide a continuous flow of steam in the drains for improving the flow of the fluids by reducing the viscosity.

Thus, in accordance with the present variant, the displacement agent or displacing agent 115 is introduced into the producing formation 113 from the annular space or injection 116 defined by casing 103 and pipe 108 which is situated in this casing 103 by passing through the perforations 111 formed in this same casing.

The displacing agent will diffuse into the producing formation 113 while causing migration of the oil effluent towards the collecting drains 106 which are perforated over the portion of their length situated in producing formation 113.

Drain 106 collects the oil effluent and discharges it into the pit 105 from which it is produced. Of course, for good efficiency of the method of the invention, it is necessary to have several collection drains situated all around the central vertical well.

Figure 8:
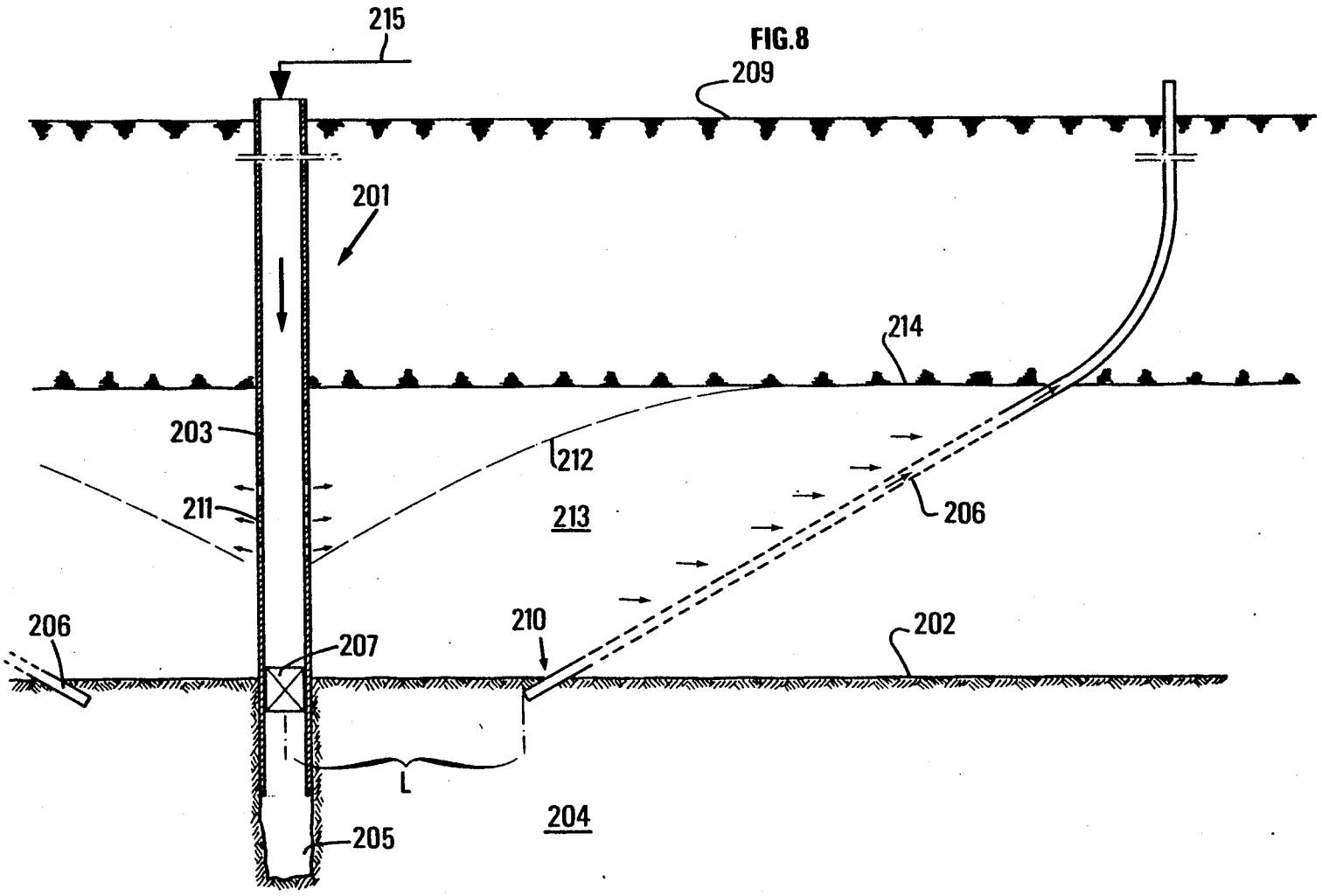

In yet another variant, in which the central well serves for injecting the displacement agent (FIG. 8) this central vertical well 201 is drilled as far as the wall 202 of a reservoir 213, then cased and cemented. Thus, casing 203 prevents any flow of fluid from the reservoir into the well.

By wall of the reservoir is meant the lower part of the geological formation containing the oil effluent and by roof of the reservoir the upper limit of this geological formation.

The drilling may then be interrupted. If it were continued in layer 204 situated under the reservoir, this extension would be advantageously isolated from the rest of the hole by means of a sealing plug 207 preventing the passage of any product towards the extension of the well, so as to provide an extension of the well intended for a subsequent use.

Extension of the well may be considered particularly when there exist several geological formations containing an effluent to be produced, separated by formations impermeable to this effluent.

In the embodiment shown, the system or device for collecting the effluent to be produced is formed by drilling subhorizontal drains 206 from the surface as far as the producing formation 213, each of these drains intersecting wall 202 of the reservoir at a point 210 distant from the central well and are substantially interrupted at the level of this point.

The injection of fluid intended to mobilize and displace the fluids in place will take place in reservoir 213 through perforations 211 formed conventionally in the casing 203 of the central well 201. The communication may be improved by acidification and stimulation of the reservoir at the level of the perforations. The size of these perforations 211 may be chosen after stimulation by means of digital programs adapted for representing the flows caused so as to obtain the best volumetric sweep of the reservoir by the injected fluids (hot water, steam, $C_2$, gas, foam, . . . ) until penetration in the drains 206 is obtained. The parameters to be taken into account are: the thickness of the reservoir, the viscosity of the oil in place, the angle of the drains with respect to the horizontal, the outlet points from the reservoir of each drain, the injection flow rate, the number of drains, . . .

In the case where the fluid injected is lighter than the oil in place, the effect of segregation by gravity may be used which allows an umbrella form to be obtained for the interface between the displacement agent and the effluent to be produced. In time, this umbrella form will develop laterally about the central well. The above mentioned parameters may then be calculated so that the limit reached by the umbrella is practically parallel to the subhorizontal drains in the respective planes of each of them. Thus, the oil will be displaced towards the drains uniformly.

Thus, in accordance with the present variant, the displacing agent 215 is introduced into the producing formation 213 from the main well by transitting through the perforations 211 formed in this same casing.

The displacing agent will diffuse into the producing formation 213 while causing migration of the oil effluent towards the collecting drains 206 which are perforated over the portion of their length situated in the producing formation 213.

Drains 206 collect the oil effluent which is produced separately from each of these drains to the surface 209. The production takes place either naturally, or by means of pumps. These pumps may be placed at the surface or inside some at least of the subhorizontal drains at the level of the producing formation.

Thus, in accordance with the present invention, the oil effluent is produced from subhorizontal drains surrounding the main well. These drains are interrupted before meeting the axis of the main well and at a certain distance L from this axis. The present invention increases then the worked volume of the reservoir.

In the case of the figure, the subhorizontal drains are interrupted substantially at the level of wall 202, however, the drains could be interrupted before or after this wall without departing from the scope of the invention.

What is claimed is:

1. A method for producing a viscous oil effluent contained in a geological formation providing a producing formation and forming a reservoir for said effluent, said geological formation overlying another geological formation at least substantially impermeable to said effluent to define an interface between said geological formations, the interface between the geological formations comprising a wall of the reservoir, which comprises:

providing a central well extending from the surface into said producing formation;

drilling at least one subhorizontal well from the surface to pass through said producing formation and into said impermeable formation;

joining an end portion of said at least one subhorizontal well to said central well; and injecting a displacement agent into said producing formation via said at least one subhorizontal well serving as a production simulation well;

said displacement agent causing migration of the effluent from the producing formation into said central well.

2. The method as claimed in claim 1, wherein said stimulation well is perforated over a portion of its length, said perforated portion corresponding substantially to the fraction of said stimulation well passing through the producing formation.

3. The method as claimed in claim 2, wherein a fluid is injected into said stimulation well adapted for reducing the viscosity of the oil effluent to be produced.

4. The method as claimed in claim 2, wherein a plug is interposed in said stimulation well and said plug is placed in said perforated portion of said stimulation well.

5. The method as claimed in claim 2, wherein a plug is interposed in said stimulation well, in the portion of said well contained in the impermeable formation.

6. The method as claimed in claim 2, wherein a plug is placed in placed in said stimulation well, substantially at the interface between the producing formation and the impermeable formation.

7. The method as claimed in claim 1, wherein said stimulation well is interrupted with a plug after reaching the producing formation, but before reaching the producing well.

8. The method as claimed in claim 1, wherein several stimulation wells are used surrounding the production well.

9. A method for producing a viscous oil effluent contained a geological formation providing a producing formation and forming a reservoir for said effluent, said geological formation overlying another geological formation at least substantially impermeable to said effluent to define an interface between said geological formations, the interface between the geological formations comprising a wall of the reservoir, which comprises:

providing a central well extending from the surface into said producing formation;

drilling at least one subhorizontal well from the surface to pass into said producing formation, an end portion of said at least one subhorizontal well being disposed at a predetermined distance from the central well and at least in close proximity to said wall of the reservoir and another portion of said at least one subhorizontal well entering the producing formation being disposed at another predetermined distance from the central well, the another portion being located further away from the central well than the end portion; and injecting a displacement agent into said producing formation via said central well, said displacement agent causing migration of the effluent from the producing formation via said at least one subhorizontal well.

10. A production method as claimed in claim 9, wherein said displacement agent is injected into said central well via a perforation zone and several subhorizontal wells are arranged around said central well to produce the migrating effluent to the surface.

11. The production method as claimed in claim 9, wherein the effluent to be produced is conveyed to the surface by a plurality of subhorizontal wells.

12. The method as claimed in claim 11, wherein said effluent is produced by subhorizontal wells situated all about said central well.

13. A method for producing a viscous oil effluent contained in a geological formation providing a producing formation and forming a reservoir for said effluent, said geological formation overlying another geological formation at least substantially impermeable to said effluent to define an interface between said geological formations, the interface between the geological formations comprising a wall of the reservoir, which comprises:

providing a central well extending from the surface into said producing formation;

drilling at least one subhorizontal well from the surface to pass through said producing formation and into said impermeable formation;

joining an end portion of said at least one subhorizontal well to said central well; and injecting a displacement agent into said producing formation via said central well; said displacement agent causing migration of the effluent from the producing formation into said central well via said at least one subhorizontal well.

14. The production method as claimed in claim 13, wherein said effluent is drained through a plurality of subhorizontal wells towards a lower part of the central well where said effluent collects and from which said effluent is produced to the surface.

15. The method as claimed in claim 14, wherein said effluent to be produced is collected by subhorizontal wells situated all about said central well.

16. The method as claimed in claim 14, wherein said effluent to be produced is drained into said lower part as far as a level lower than said wall of the reservoir.

17. The production system as claimed in claim 13, including a plug.

18. The system as claimed in claim 13 applied to the case where said geological formation overlies another geological formation impermeable to the effluent to be produced, wherein said subhorizontal drains are interrupted substantially in the vicinity of an interface between said impermeable formation and said geological formation containing the effluent to be produced.

19. A system for producing an effluent contained in a geological formation including a central well and subhorizontal wells, said central well comprising a perforated zone at a level of said geological formation and a transition zone isolated from the perforated zone and situated below said perforated zone and below said geological formation, said transit zone being connected to the surface by a production pipe, an injection pipe connecting said perforated zone to a source for injecting a displacement agent into said perforated zone, said subhorizontal wells extending through said geological formation and being joined to said transit zone.

20. The production system as claimed in claim 19, wherein a tube situated in said central well comprises the production pipe, the injection pipe comprising an annular space defined by said central well and said tube and said annular space including a plug which isolates the perforated zone from the transit zone.

21. The system as claimed in claim 20, wherein said tube passes through said plug.

22. The system as claimed in claim 21, wherein said production pipe includes a pump situated at its lower end in the transit zone and said tube forming said production pipe may slide in said plug.

23. The system as claimed in claim 19 wherein said production pipe includes a pump situated at the lower end of said production pipe, in the transit zone.

24. The system as claimed in claim 19 wherein said transit zone has a cross section larger than the cross section of the upper part of the main well, thus forming a pit for collecting the effluent produced.

25. The system as claimed in claim 19 applied to the case where said geological formation overlies another geological formation impermeable to the effluent to be produced, wherein said collection zone is situated at least partially in said impermeable formation and said subhorizontal drains join with said transit zone by penetrating into said impermeable formation after passing through the producing formation.

26. A system for producing an effluent contained in a geological formation including a central well and subhorizontal wells, said central well having a perforated zone at a level of said geological formation, an injection pipe connecting said perforated zone to a source for injecting a displacement agent into said perforated zone; said subhorizontal wells each extending from the surface into and through said geological formation, and each of said subhorizontal wells having a length so as to enter the geological formation at a distance far from an axis of said central well and terminate at a distance near the axis of said central well, a portion of each subhorizontal well within the geological formation having a perforated zone whereby said displacement agent causes migration of the effluent from the geological formation into said subhorizontal wells.

* * * * *